US009784266B2

(12) United States Patent
Bang et al.

(10) Patent No.: US 9,784,266 B2
(45) Date of Patent: Oct. 10, 2017

(54) APPARATUS AND METHOD FOR CONTROLLING PREFERENTIAL FUNCTION OF CONSTRUCTION MACHINE

(71) Applicant: VOLVO CONSTRUCTION EQUIPMENT AB, Eskilstuna (SE)

(72) Inventors: Sang-Ho Bang, Changwon-si (KR); Hung-Ju Shin, Busan (KR)

(73) Assignee: VOLVO CONSTRUCTION EQUIPMENT AB (SE)

( * ) Notice: Subject to any disclaimer, the term of this patent is extended or adjusted under 35 U.S.C. 154(b) by 223 days.

(21) Appl. No.: 14/443,425

(22) PCT Filed: Nov. 23, 2012

(86) PCT No.: PCT/KR2012/009959

§ 371 (c)(1),
(2) Date: May 18, 2015

(87) PCT Pub. No.: WO2014/081053

PCT Pub. Date: May 30, 2014

(65) Prior Publication Data

US 2015/0285241 A1 Oct. 8, 2015

(51) Int. Cl.
*E02F 3/96* (2006.01)
*E02F 9/22* (2006.01)
(Continued)

(52) U.S. Cl.
CPC ..... *F04B 49/065* (2013.01); *E02F 3/96* (2013.01); *E02F 9/2228* (2013.01);
(Continued)

(58) Field of Classification Search
CPC ... E02F 3/96; E02F 9/2075; E02F 9/22; E02F 9/2217; E02F 9/2225; F02D 29/02; F04B 49/06; B66D 1/44; F15B 13/0405
See application file for complete search history.

(56) References Cited

U.S. PATENT DOCUMENTS 4,706,932 A * 11/1987 Yoshida ..... F15B 13/0405 137/596.16
5,134,853 A * 8/1992 Hirata ..... E02F 9/2225 60/420
(Continued)

FOREIGN PATENT DOCUMENTS

EP 1416096 A1 5/2004
EP 1172488 B1 3/2007
(Continued)

OTHER PUBLICATIONS

Notification of Reason for Refusal (in Korean) regarding corresponding Korean patent application issued by the Korean Intellectual Property Office (KIPO) on Dec. 9, 2016 (6 pages).
(Continued)

*Primary Examiner* — Yuri Kan
(74) *Attorney, Agent, or Firm* — Harness, Dickey & Pierce, P.L.C.

(57) ABSTRACT

A priority function control apparatus for a construction machine and a control method thereof are disclosed, which enable an operator to set the order of preference or the extent of preference of an optional device in the case where a work is done through replacement of the optional device attached to an excavator. The priority function control apparatus includes a hydraulic pump and a pilot pump; an optional device and an attachment connected to the hydraulic pump; an attachment operation lever outputting an operation signal when an operator performs an operation; an optional device spool controlling a flow direction of hydraulic fluid that is supplied from the hydraulic pump to the optional device; an attachment spool controlling an amount and a flow direction of the hydraulic fluid supplied from the hydraulic pump to the attachment; an electrical operation device for the optional device; an electro proportional reducing valve outputting secondary signal pressure that corresponds to the
(Continued)

operation signal of the electrical operation device for the optional device; a first pressure detection sensor detecting in real time signal pressure depending on the operation amount of the attachment operation lever to output a detection signal; and a controller limiting the signal pressure that is applied from the electro proportional reducing valve to the optional device spool by the operation of the electrical operation device for the optional device to a preset signal pressure if a priority function is applied depending on the operation amount of the attachment through detection of the first pressure detection sensor.

10 Claims, 7 Drawing Sheets

(51) Int. Cl.
*F04B 49/06* (2006.01)
*F15B 11/16* (2006.01)

(52) U.S. Cl.
CPC ..... *E02F 9/2282* (2013.01); *E02F 9/2285* (2013.01); *E02F 9/2296* (2013.01); *F15B 11/166* (2013.01)

(56) References Cited

U.S. PATENT DOCUMENTS 5,186,000 A * 2/1993 Hirata ..... E02F 9/2225 60/420
5,488,787 A * 2/1996 Aoyagi ..... E02F 9/2217 172/2
5,497,805 A * 3/1996 Sunamura ..... E02F 9/22 137/596.16
6,438,953 B1 8/2002 Kamada
6,971,302 B2 12/2005 Lee
6,973,866 B2 12/2005 Lee
8,818,651 B2 8/2014 Joung et al.
2002/0134227 A1* 9/2002 Nakatani ..... E02F 9/22 91/446
2004/0261405 A1 12/2004 Lee
2004/0261406 A1 12/2004 Lee
2009/0031720 A1 2/2009 Son
2012/0285159 A1* 11/2012 Sugano ..... B66D 1/44 60/470
2012/0291427 A1 11/2012 Azuma et al.
2013/0098021 A1 4/2013 Shin et al.
2013/0121852 A1 5/2013 Joung et al.
2013/0160439 A1 6/2013 Lee et al.
2013/0263583 A1 10/2013 Shin
2014/0174068 A1* 6/2014 Mori ..... F04B 49/06 60/328
2015/0008054 A1* 1/2015 Hoshino ..... E02F 9/2075 180/65.26
2015/0027112 A1* 1/2015 Takebayashi ..... E02F 9/2285 60/393
2015/0225927 A1* 8/2015 Hoshino ..... F02D 29/02 701/50

FOREIGN PATENT DOCUMENTS

JP 2002-115274 A 4/2002
JP 2005-016720 A 1/2005
KR 10-2005-0000821 A 1/2005
KR 10-2006-0078301 A 7/2006
KR 10-2009-0006929 A 1/2009
KR 10-2009-0012533 A 2/2009

OTHER PUBLICATIONS

Extended European Search Report issued by the European Patent Office (EPO) on Jul. 8, 2016 regarding corresponding EP Application No. 12888766.8 (10 pages).
International Search Report (in Korean and English) and Written Opinion (in Korean) for PCT/KR2012/009959, mailed May 9, 2013; ISA/KR.

* cited by examiner

Prior art

APPARATUS AND METHOD FOR CONTROLLING PREFERENTIAL FUNCTION OF CONSTRUCTION MACHINE

TECHNICAL FIELD

The present invention relates to an apparatus and method for controlling a preferential function of construction machine, and more particularly, to a hydraulic priority function control apparatus for construction machine and method thereof, which can enable an operator to set the order of preference or the extent of preference of an optional device in the case where a combined work is done through replacement of the optional device attached to an excavator.

BACKGROUND OF THE INVENTION

In general, depending on working conditions, an optional device, such as a breaker, may be mounted after a bucket of an excavator is carried off, and a combined work may be done through simultaneous driving of the optional device and an attachment. In this case, due to a difference in load pressure between the optional device and the attachment, hydraulic fluid may not be smoothly supplied from a hydraulic pump to the optional device and the attachment. Accordingly, by limiting the amount of hydraulic fluid that is supplied from the hydraulic pump to the optional device through a priority function, movement of the attachment can be prevented from being limited.

A priority function control apparatus for a construction machine in the related art, as illustrated in FIG. 1, includes a variable displacement hydraulic pump (hereinafter referred to as "hydraulic pump") 1 connected to an engine, an optional device and an attachment (not illustrated) connected to the hydraulic pump 1, an optional device operation lever 2 and an attachment operation lever 3 outputting operation signals that correspond to their amounts of operation when an operator operates them, an optional device spool 4 installed in a flow path between the hydraulic pump 1 and the optional device and shifted to control a flow direction of hydraulic fluid that is supplied to the optional device in response to an operation of the optional device operation lever 2, and an attachment spool 5 installed in a flow path between the hydraulic pump 1 and the attachment and shifted to control a start, a stop, and a direction change of the attachment in response to an operation of the attachment operation lever 3.

As illustrated in FIG. 1, in the case where a combined work is done by driving the optional device and the attachment, which share the hydraulic pump 1, through operation of the optional device operation lever 2 and the attachment operation lever 3, the hydraulic fluid may not be smoothly supplied from the hydraulic pump 1 due to the difference in load pressure between the optional device and the attachment. That is, if the load pressure that is generated in the optional device is relatively lower than the load pressure that is generated in the attachment, the amount of hydraulic fluid that is supplied from the hydraulic pump 1 to the optional device is increased according to the hydraulic characteristics, and thus the movement of the attachment may be limited.

Accordingly, an orifice 6 is installed in a flow path between the hydraulic pump 1 and the optional device spool 4 so as to limit the amount of hydraulic fluid that is supplied to the optional device during the combined work in which the optional device and the attachment are simultaneously driven.

Another priority function control apparatus for a construction machine in the related art, as illustrated in FIG. 2, includes a variable displacement hydraulic pump (hereinafter referred to as "hydraulic pump") 1 connected to an engine, an optional device and an attachment (not illustrated) connected to the hydraulic pump 1, an optional device operation lever 2 and an attachment operation lever 3 outputting operation signals that correspond to their amounts of operation when an operator operates them, an optional device spool 4 installed in a flow path between the hydraulic pump 1 and the optional device and shifted to control a flow direction of hydraulic fluid that is supplied to the optional device in response to an operation of the optional device operation lever 2, an attachment spool 5 installed in a flow path between the hydraulic pump 1 and the attachment and shifted to control a start, a stop, and a direction change of the attachment in response to an operation of the attachment operation lever 3, and a hydraulic pressure reducing valve 7 installed in a signal path between the optional device operation lever 2 and the optional device spool 4 and shifted to control signal pressure that is input from the optional device operation lever 2 to the optional device spool 4 in response to signal pressure from an outside.

Accordingly, in the case where a combined work is done by driving the optional device and the attachment through operation of the optional device operation lever 2 and the attachment operation lever 3, the amount of hydraulic fluid that is supplied to the optional device by the hydraulic reducing valve 7 is limited, and thus the movement of the attachment can be prevented from being limited.

However, as illustrated in FIGS. 1 and 2, in the case where the amount of hydraulic fluid that is supplied to the optional device by the orifice 6 and the hydraulic reducing valve 7, it may be difficult to smoothly adjust the extent of the priority function in accordance with the load conditions of the optional device. Further, an interface through which an operator can easily set the priority function is not provided, and in the case where the load conditions of the optional device are varied, it may be difficult to easily cope with such variation.

Still another priority function control apparatus for a construction machine in the related art, as illustrated in FIG. 3, includes a variable displacement hydraulic pump (hereinafter referred to as "hydraulic pump") 1 and a pilot pump 8 connected to an engine, an optional device and an attachment (not illustrated) connected to the hydraulic pump 1, an attachment operation lever 3 outputting an operation signal that corresponds to the operation amount when an operator operates the attachment operation lever 3, an optional device spool 4 installed in a flow path between the hydraulic pump 1 and the optional device and shifted to control a flow direction of hydraulic fluid that is supplied to the optional device, an attachment spool 5 installed in a flow path between the hydraulic pump 1 and the attachment and shifted to control a start, a stop, and a direction change of the attachment in response to an operation of the attachment operation lever 3, an electrical operation device 9 for the optional device outputting an operation signal in accordance with an operator's operation to control the optional device, an electro proportional pressure reducing valve 10 installed in a signal path between the pilot pump 8 and the optional device spool 4 and shifted to convert signal pressure from the pilot pump 8 into secondary signal pressure so as to correspond to an electrical control signal from an outside and to supply the secondary signal pressure to the optional device spool 4, and a controller 11 outputting the electrical control signal that corresponds to the operation signal of the electrical operation device 9 for the optional device to the electro proportional pressure reducing valve 10.

Accordingly, in the case where the electrical operation device 9 for the optional device and the attachment operation lever 3 are operated, the operation signal that is generated in accordance with the operation of the electrical operation device 9 for the optional device is input to the controller. In accordance with the electrical control signal that is output from the controller 11 to correspond to the operation signal, the electro proportional pressure reducing valve 10 generates the secondary signal pressure. Accordingly, since the opening amount of the optional device spool 4 is controlled by the secondary signal pressure that passes through the electro proportional pressure reducing valve 10 to limit the amount of hydraulic fluid that is supplied to the optional device, the movement of the attachment can be prevented from being limited.

However, as illustrated in FIG. 3, in the case where a separate input signal algorithm or device, which can set the extent of the preference in accordance with the load conditions of the optional device or the operation amount of the attachment, is not provided, the movement of the specific attachment may be limited due to the load pressure that is generated in the optional device.

SUMMARY OF THE INVENTION

Accordingly, the present invention has been made to solve the aforementioned problems occurring in the prior art, and it is an object of the present invention to provide a priority function control apparatus for a construction machine and a control method thereof, which can prevent the movement of an attachment from being limited or prevent the driving speed thereof from being increased due to load pressure of an optional device in the case where a work is done through operation of the optional device and the attachment.

It is another object of the present invention to provide a priority function control apparatus for a construction machine and a control method thereof, which can enable an operator to set the order of preference or the extent of preference of various kinds of optional devices and thus can easily cope with the change of load conditions due to replacement of the optional devices.

TECHNICAL SOLUTION

To achieve the above objects, in accordance with a first embodiment of the present invention, there is provided a priority function control apparatus for construction machine, which includes a variable displacement hydraulic pump and a pilot pump connected to an engine; an optional device and an attachment connected to the hydraulic pump; an attachment operation lever outputting an operation signal that corresponds to an operation amount when an operator performs an operation; an optional device spool installed in a flow path between the hydraulic pump and the optional device and shifted to control a flow direction of hydraulic fluid that is supplied to the optional device in response to signal pressure from an outside; an attachment spool installed in a flow path between the hydraulic pump and the attachment and shifted to control a start, a stop, and a direction change of the attachment in response to the operation of the attachment operation lever; an electrical operation device for the optional device outputting an operation signal in accordance with an operator's operation; an electro proportional reducing valve installed in a signal path between the pilot pump and the optional device spool to output secondary signal pressure that corresponds to the operation signal of the electrical operation device for the optional device; a first pressure detection sensor installed in a signal path between the attachment operation lever and the attachment spool to detect in real time signal pressure depending on the operation amount of the attachment operation lever and to output a detection signal; and a controller presetting a priority value or a ratio by the operator in consideration of load pressure of the optional device, and limiting the signal pressure that is applied from the electro proportional reducing valve to the optional device spool by the operation of the electrical operation device for the optional device to a preset signal pressure if a priority function is applied depending on the operation amount of the attachment through detection of the first pressure detection sensor.

In accordance with a second embodiment of the present invention, there is provided a priority function control apparatus for a construction machine, which includes a variable displacement hydraulic pump and a pilot pump connected to an engine; an optional device and an attachment connected to the hydraulic pump; an attachment operation lever outputting an operation signal that corresponds to an operation amount when an operator performs an operation; an optional device spool installed in a flow path between the hydraulic pump and the optional device and shifted to control a flow direction of hydraulic fluid that is supplied to the optional device in response to signal pressure from an outside; an attachment spool installed in a flow path between the hydraulic pump and the attachment and shifted to control a start, a stop, and a direction change of the attachment in response to the operation of the attachment operation lever; an electrical operation device for the optional device outputting an operation signal in accordance with an operator's operation; an electro proportional reducing valve installed in a signal path between the pilot pump and the optional device spool to output secondary signal pressure that corresponds to the operation signal of the electrical operation device for the optional device; a second pressure detection sensor installed in an upstream discharge flow path of the hydraulic pump to detect in real time load pressure of the hydraulic pump and to output a detection signal; a third pressure detection sensor installed in a flow path between the attachment spool and the attachment to detect in real time load pressure of the attachment and to output a detection signal; and a controller presetting a priority value or a ratio by the operator in consideration of load pressure of the optional device, and limiting the signal pressure that is applied from the electro proportional reducing valve to the optional device spool by the operation of the electrical operation device for the optional device to a preset signal pressure so that a difference value between the load pressure of the hydraulic pump that is formed by the load pressure of the attachment when the optional device is not used and the load pressure of the hydraulic pump that is formed by the load pressure of the attachment when the optional device is used becomes equal to or smaller than a preset value by the priority value or the ratio set by the operator.

In accordance with a first embodiment of the present invention, there is provided a method for controlling a priority function control apparatus for a construction machine, including a variable displacement hydraulic pump and a pilot pump connected to an engine; an optional device and an attachment connected to the hydraulic pump; an attachment operation lever outputting an operation signal that corresponds to an operation amount when an operator performs an operation; an optional device spool installed in a flow path between the hydraulic pump and the optional device and shifted to control a flow direction of hydraulic fluid that is supplied to the optional device in response to signal pressure from an outside; an attachment spool installed in a flow path between the hydraulic pump and the attachment and shifted to control a start, a stop, and a direction change of the attachment in response to the operation of the attachment operation lever; an electrical operation device for the optional device outputting an operation signal in accordance with an operator's operation; an electro proportional reducing valve installed in a signal path between the pilot pump and the optional device spool to output secondary signal pressure that corresponds to the operation signal of the electrical operation device for the optional device; and a controller outputting an electrical control signal that corresponds to the operation signal of the electrical operation device for the optional device to the electro proportional reducing valve, the method includes presetting a priority value or a ratio by the operator in consideration of load pressure of the optional device; detecting in real time signal pressure depending on the operation amount of the attachment operation lever by a first pressure detection sensor installed in a signal path between the attachment operation lever and the attachment spool; and limiting the secondary signal pressure that is applied from the electro proportional reducing valve to the optional device spool to a preset signal pressure if a priority function is applied depending on the operation amount of the attachment through detection of the first pressure detection sensor.

In accordance with a second embodiment of the present invention, there is provided a method for controlling a priority function control apparatus for a construction machine, including a variable displacement hydraulic pump and a pilot pump connected to an engine; an optional device and an attachment connected to the hydraulic pump; an attachment operation lever outputting an operation signal that corresponds to an operation amount when an operator performs an operation; an optional device spool installed in a flow path between the hydraulic pump and the optional device and shifted to control a flow direction of hydraulic fluid that is supplied to the optional device in response to signal pressure from an outside; an attachment spool installed in a flow path between the hydraulic pump and the attachment and shifted to control a start, a stop, and a direction change of the attachment in response to the operation of the attachment operation lever; an electrical operation device for the optional device outputting an operation signal in accordance with an operator's operation; an electro proportional reducing valve installed in a signal path between the pilot pump and the optional device spool to output secondary signal pressure that corresponds to the operation signal of the electrical operation device for the optional device; and a controller outputting an electrical control signal that corresponds to the operation signal of the electrical operation device for the optional device to the electro proportional reducing valve, the method includes presetting a priority value or a ratio by the operator in consideration of load pressure of the optional device; detecting in real time load pressure of the hydraulic pump by detection of a second pressure detection sensor installed in an upstream discharge flow path of the hydraulic pump, and detecting in real time load pressure of the attachment by detection of a third pressure detection sensor installed in a flow path between the attachment spool and the attachment; and limiting the signal pressure that is applied from the electro proportional reducing valve to the optional device spool by the operation of the electrical operation device for the optional device to a preset signal pressure so that a difference value between the load pressure of the hydraulic pump that is formed by the load pressure of the attachment when the optional device is not used and the load pressure of the hydraulic pump that is formed by the load pressure of the attachment when the optional device is used becomes equal to or smaller than a preset value by the priority value or the ratio set by the operator.

In accordance with a third embodiment of the present invention, there is provided a method for controlling a priority function control apparatus for a construction machine, including a variable displacement hydraulic pump and a pilot pump connected to an engine; an optional device and an attachment connected to the hydraulic pump; an attachment operation lever outputting an operation signal that corresponds to an operation amount when an operator performs an operation; an optional device spool installed in a flow path between the hydraulic pump and the optional device and shifted to control a flow direction of hydraulic fluid that is supplied to the optional device in response to signal pressure from an outside; an attachment spool installed in a flow path between the hydraulic pump and the attachment and shifted to control a start, a stop, and a direction change of the attachment in response to the operation of the attachment operation lever; an electrical operation device for the optional device outputting an operation signal in accordance with an operator's operation; an electro proportional reducing valve installed in a signal path between the pilot pump and the optional device spool to output secondary signal pressure that corresponds to the operation signal of the electrical operation device for the optional device; and a controller outputting an electrical control signal that corresponds to the operation signal of the electrical operation device for the optional device to the electro proportional reducing valve, the method includes presetting a priority value or a ratio by the operator in consideration of load pressure of the optional device; and limiting the signal pressure that is applied from the electro proportional reducing valve to the optional device spool depending on a priority value or a ratio that is preset when the electrical operation device for the optional device is operated.

The controller may output the electrical control signal that corresponds to an operation amount of the electrical operation device for the optional device to the electro proportional reducing valve when the electrical operation device for the optional device is operated, in the case where the priority function is not applied, with the signal pressure that is applied to the optional device spool by the operation of the electrical operation device for the optional device, and the controller may output the electrical control signal that limits the operation amount of the electrical operation device for the optional device to the electro proportional reducing valve when the electrical operation device for the optional device is operated, in the case where the priority function is applied, with the signal pressure that is applied to the optional device spool by the operation of the electrical operation device for the optional device.

The controller may determine that the priority function is not applied if the operation amount of the attachment operation lever by the detection of the first pressure detection sensor is smaller than a preset value, and output the electrical control signal that corresponds to an operation amount of the electrical operation device for the optional device to the electro proportional reducing valve when the electrical operation device for the optional device is operated, and the controller may determine that the priority function is applied if the operation amount of the attachment operation lever by the detection of the first pressure detection sensor is equal to or larger than the preset value, and output the electrical control signal that can gradually limit the operation amount of the electrical operation device for the optional device in reverse proportion to the operation amount to the electro proportional reducing valve when the electrical operation device for the optional device is operated.

If a plurality of optional devices having different load pressures are provided and replaced, the controller may display the priority value or the ratio of each of the optional devices that is preset in the controller by the operator as a bar graph displayed on a cluster of equipment.

If a plurality of optional devices having different load pressures are provided and replaced, the controller may select any one of the plurality of optional devices that are displayed on a cluster of equipment, and control increment/decrement of the priority value or the ratio of the optional device selected by the operator by a control button.

The controller may include a fourth pressure detection sensor installed in a flow path between the optional device spool and the optional device.

The detected load pressure of the optional device may be displayed on a cluster of a cabin so that the operator can recognize the load pressure of the optional device that is detected by the fourth pressure detection sensor.

ADVANTAGEOUS EFFECT

According to the present invention having the above-described configuration, since the order of preference of the optional device can be automatically or manually adjusted, the movement of the attachment or the increase of the driving speed due to the load pressure of the optional device can be prevented during working through the operation of the optional device and the attachment, and thus operability can be improved.

Further, since the operator can set the order of preference or the extent of preference of various kinds of optional devices, it becomes possible to easily cope with the change of the load conditions due to the replacement of the optional device or the change of the working conditions, and thus work efficiency can be improved.

BRIEF DESCRIPTION OF THE DRAWINGS

The above objects, other features and advantages of the present invention will become more apparent by describing the preferred embodiments thereof with reference to the accompanying drawings, in which.

EXPLANATION OF REFERENCE NUMERALS FOR MAIN PARTS IN THE DRAWING

Figure 1:
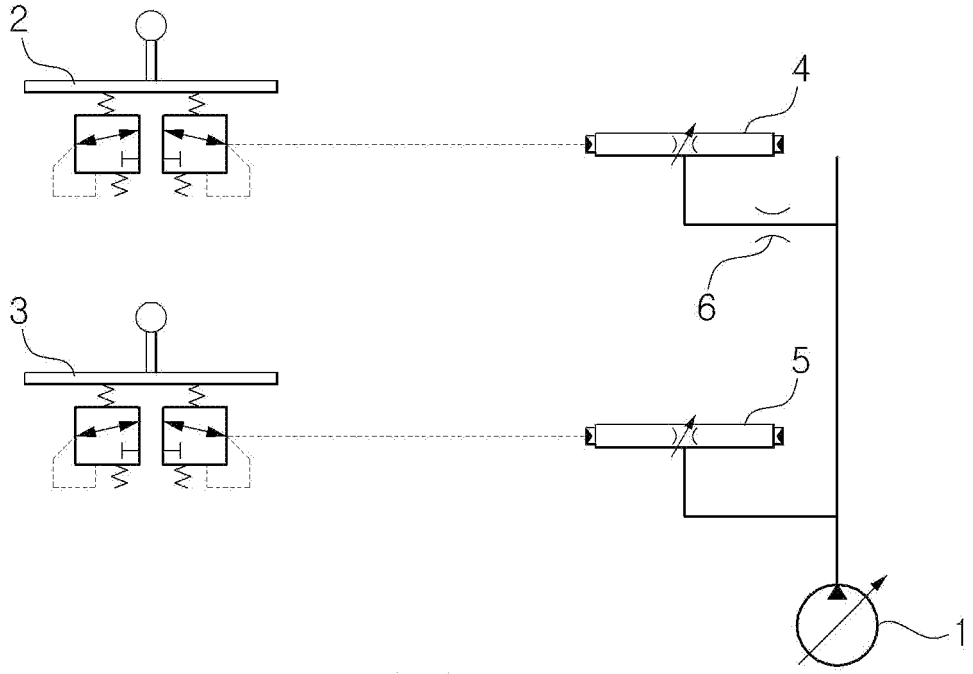
FIG. 1 is a hydraulic circuit diagram of a priority function control apparatus for a construction machine in the related art.
Figure 2:
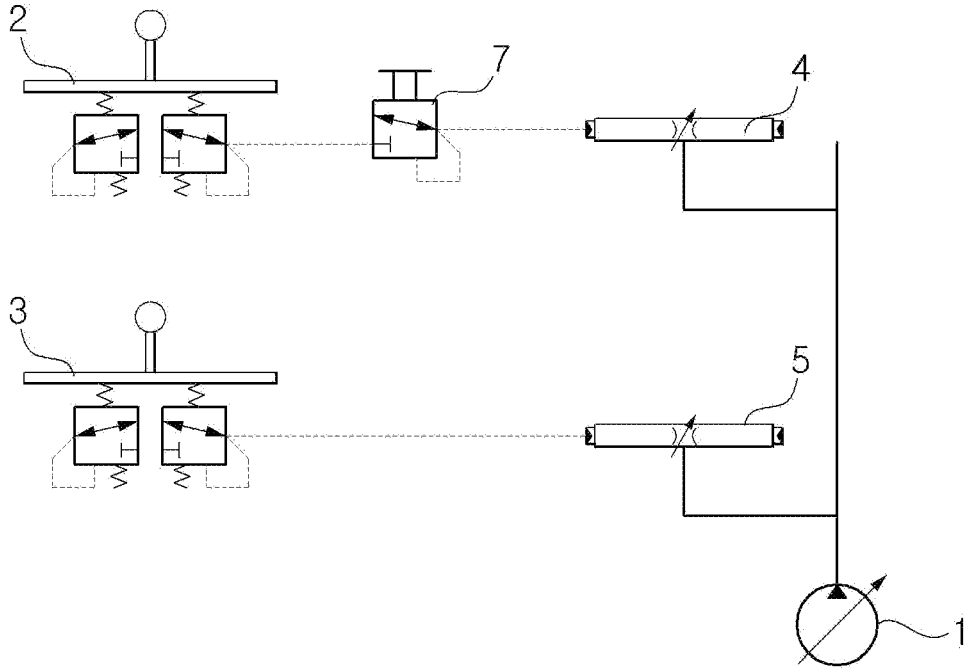
Prior art FIG. 2
FIG. 2 is a hydraulic circuit diagram of another priority function control apparatus for a construction machine in the related art.
Figure 3:
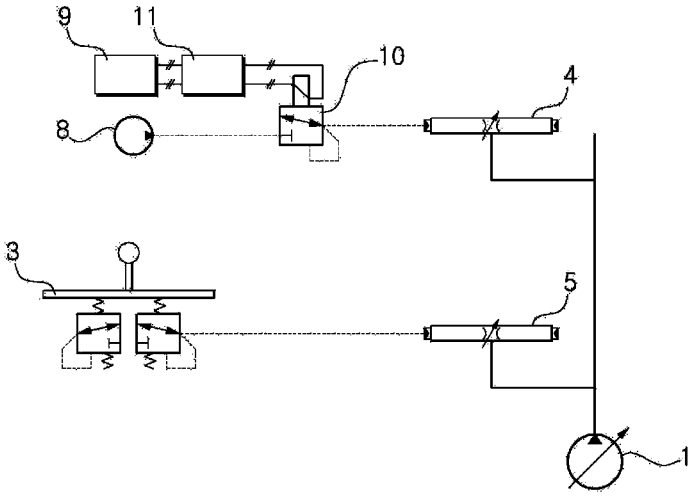
FIG. 3 is a hydraulic circuit diagram of still another priority function control apparatus for a construction machine in the related art.

1: variable displacement hydraulic pump
3: attachment operation lever
4: optional device spool
5: attachment spool
8: pilot pump
9: electrical operation device for an optional device
10: electro proportional pressure reducing valve
11: controller
12: first pressure detection sensor
13: second pressure detection sensor
14: third pressure detection sensor
15: fourth pressure detection sensor
16: control button

DETAILED DESCRIPTION OF THE INVENTION

Hereinafter, a priority function control apparatus for a construction machine and a method for controlling the same in accordance with preferred embodiments of the present invention will be described in detail with reference to the accompanying drawings.

Figure 4:
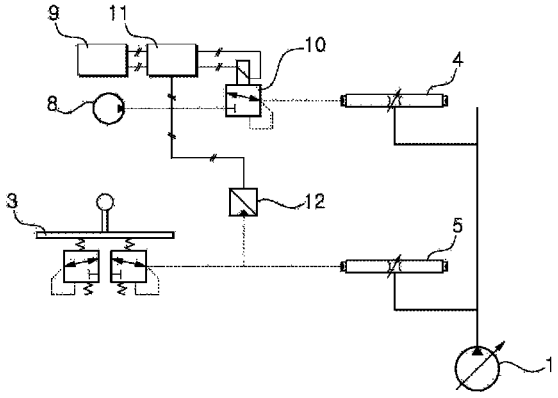
Prior art FIG. 4
FIG. 4 is a hydraulic circuit diagram of a priority function control apparatus for a construction machine in accordance with a first preferred embodiment of the present invention.
Figure 5:
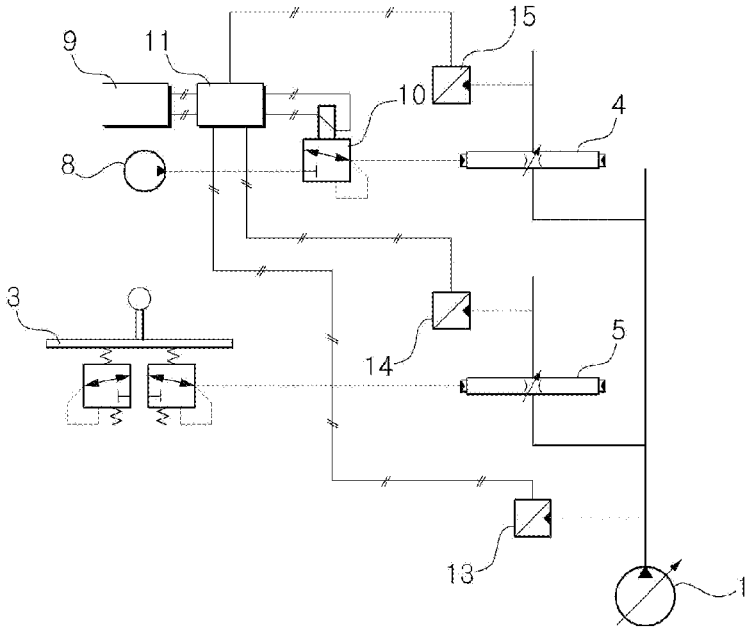
FIG. 5 is a hydraulic circuit diagram of a priority function control apparatus for a construction machine in accordance with a second preferred embodiment of the present invention.
Figure 6:
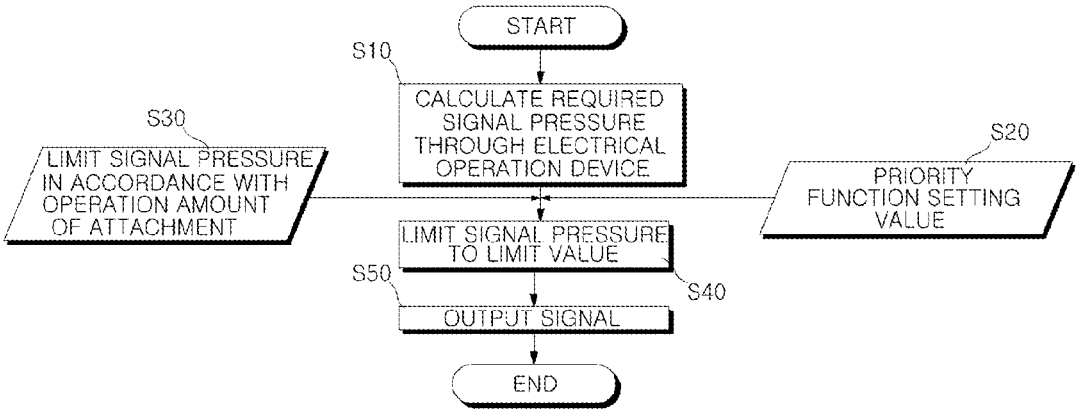
FIG. 6 is a flowchart illustrating a method for controlling a priority function control apparatus for a construction machine in accordance with a first preferred embodiment of the present invention.
Figure 7:
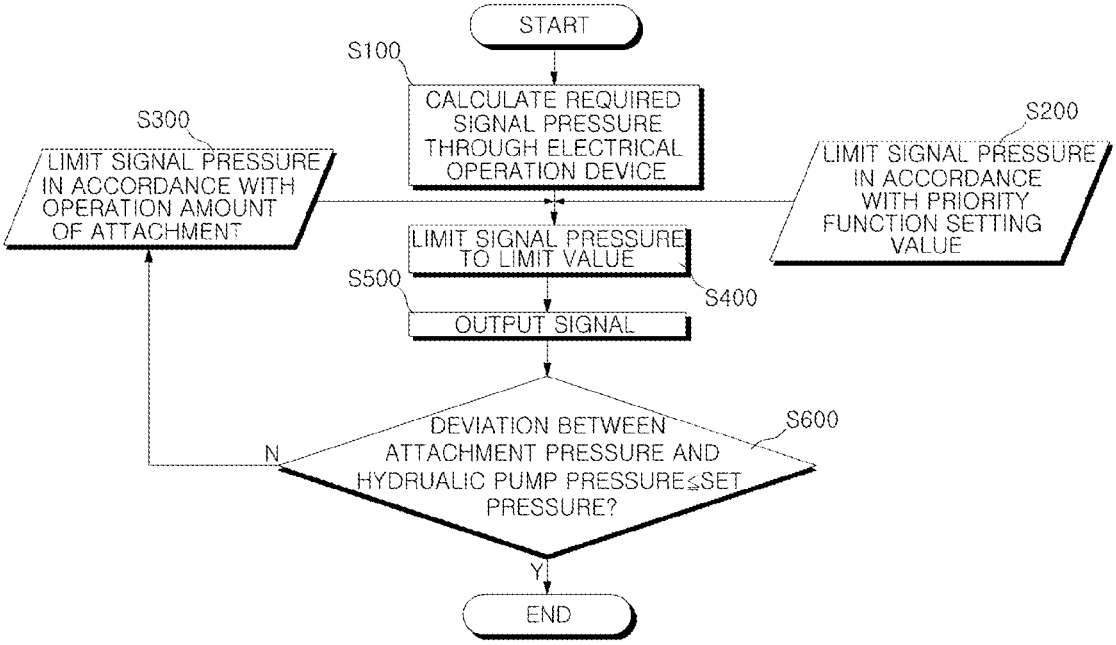
FIG. 7 is a flowchart illustrating a method for controlling a priority function control apparatus for a construction machine in accordance with a second preferred embodiment of the present invention.
Figure 8:
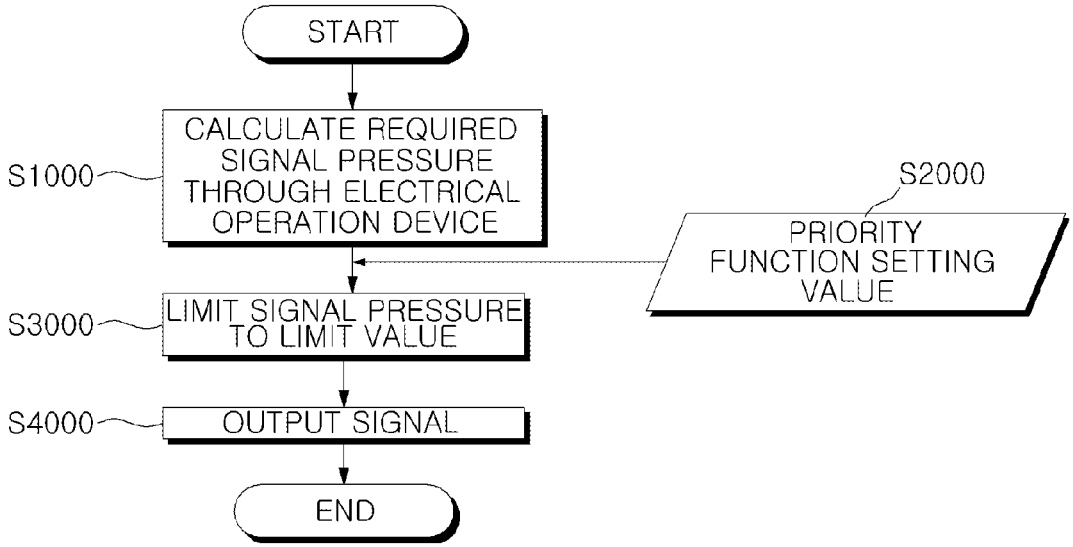
FIG. 8 is a flowchart illustrating a method for controlling a priority function control apparatus for a construction machine in accordance with a third preferred embodiment of the present invention.
Figure 9:
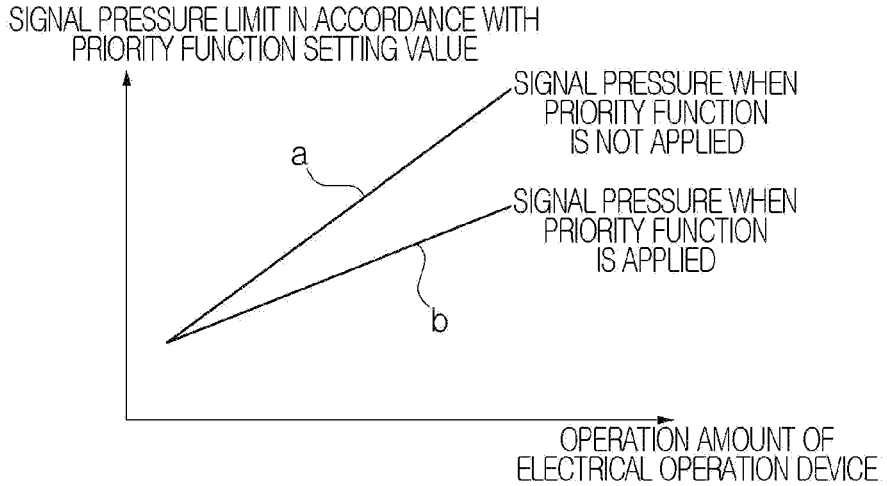
FIG. 9 is a graph showing that signal pressure that is applied to an optional device spool is limited in accordance with the extent of preference set by an operator in a method for controlling a priority function control apparatus for a construction machine in accordance with a preferred embodiment of the present invention.
Figure 10:
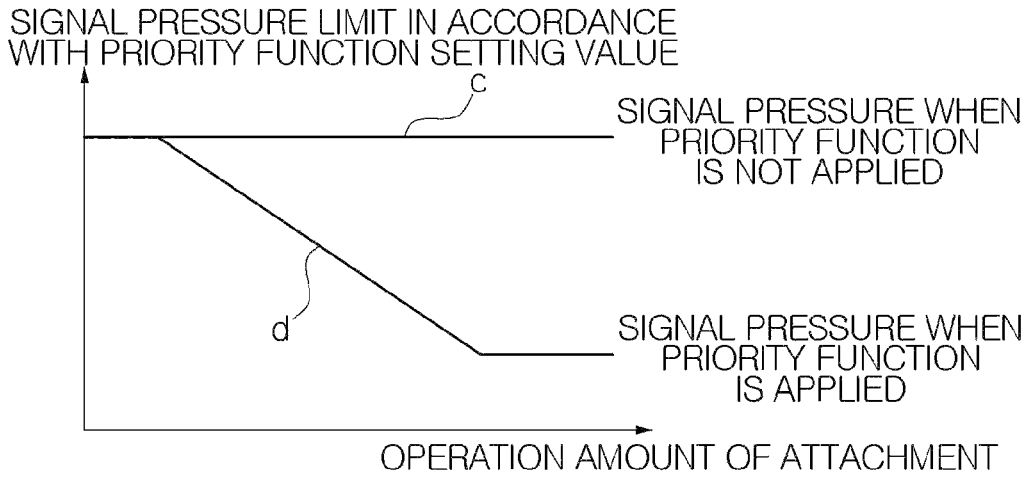
FIG. 10 is a graph showing that signal pressure that is applied to an optional device spool is limited in accordance with an operation amount of an attachment in a method for controlling a priority function control apparatus for a construction machine in accordance with a preferred embodiment of the present invention.
Figure 11:
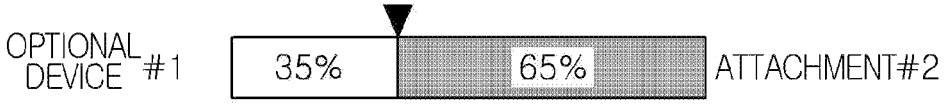
FIG. 11 is a diagram illustrating a first example in which an operator can set a priority function in a method for controlling a priority function control apparatus for a construction machine in accordance with a preferred embodiment of the present invention.
Figure 12:
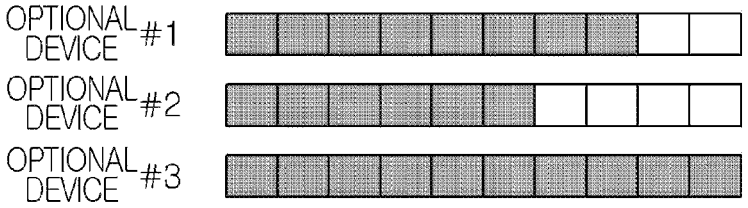
FIG. 12 is a diagram illustrating a second example in which an operator can set a priority function in a method for controlling a priority function control apparatus for a construction machine in accordance with a preferred embodiment of the present invention.
Figure 13:
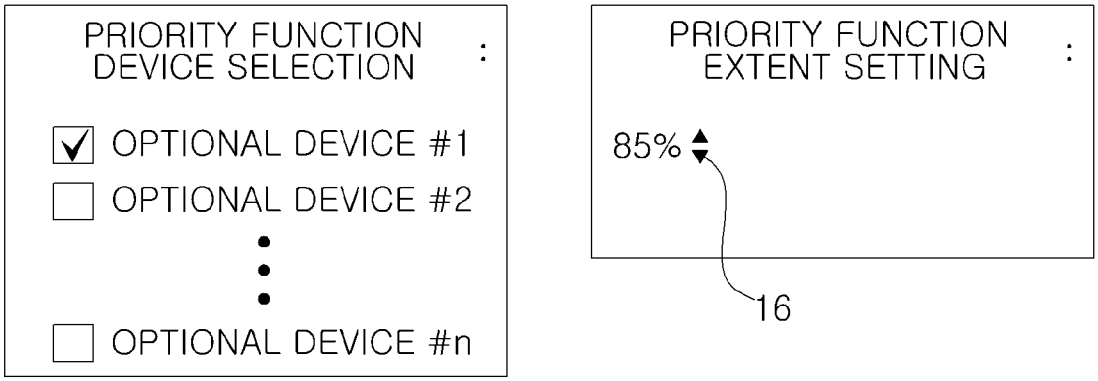
FIG. 13 is a diagram illustrating a third example in which an operator can set a priority function in a method for controlling a priority function control apparatus for a construction machine in accordance with a preferred embodiment of the present invention.

FIGS. 4 and 5 are hydraulic circuit diagrams of a priority function control apparatus for a construction machine in accordance with first and second preferred embodiments of the present invention. FIG. 6 is a flowchart illustrating a method for controlling a priority function control apparatus for a construction machine in accordance with a first preferred embodiment of the present invention, FIG. 7 is a flowchart illustrating a method for controlling a priority function control apparatus for a construction machine in accordance with a second preferred embodiment of the present invention, and FIG. 8 is a flowchart illustrating a method for controlling a priority function control apparatus for a construction machine in accordance with a third preferred embodiment of the present invention. FIG. 9 is a graph showing that signal pressure that is applied to an optional device spool is limited in accordance with the extent of preference set by an operator in a method for controlling a priority function control apparatus for a construction machine in accordance with a preferred embodiment of the present invention, and FIG. 10 is a graph showing that signal pressure that is applied to an optional device spool is limited in accordance with an operation amount of an attachment in a method for controlling a priority function control apparatus for a construction machine in accordance with a preferred embodiment of the present invention. FIGS. 11 to 13 are diagrams illustrating examples in which an operator can set a priority function in a method for controlling a priority function control apparatus for a construction machine in accordance with preferred embodiments of the present invention.

Referring to FIG. 4, a priority function control apparatus for a construction machine in accordance with a first embodiment of the present invention includes a variable displacement hydraulic pump (hereinafter referred to as "hydraulic pump") 1 and a pilot pump 8 connected to an engine (not illustrated); an optional device (not illustrated) (e.g., breaker) and an attachment (e.g., boom cylinder) connected to the hydraulic pump 1; an attachment operation lever 3 outputting an operation signal that corresponds to an operation amount when an operator performs an operation; an optional device spool 4 installed in a flow path between the hydraulic pump 1 and the optional device and shifted to control a flow direction of hydraulic fluid that is supplied to the optional device in response to signal pressure from an outside; an attachment spool 5 installed in a flow path between the hydraulic pump 1 and the attachment and shifted to control a start, a stop, and a direction change of the attachment in response to the operation of the attachment operation lever 3; an electrical operation device 9 for the optional device outputting an operation signal in accordance with an operator's operation; an electro proportional reducing valve 10 installed in a signal path between the pilot pump 8 and the optional device spool 4 to output secondary signal pressure that corresponds to the operation signal of the electrical operation device 9 for the optional device; a first pressure detection sensor 12 installed in a signal path between the attachment operation lever 3 and the attachment spool 5 to detect in real time signal pressure depending on the operation amount of the attachment operation lever 3 and to output a detection signal to a controller 11; and the controller 11 presetting a priority value or a ratio by the operator in consideration of load pressure of the optional device, and limiting the signal pressure that is applied from the electro proportional reducing valve 10 to the optional device spool 4 by the operation of the electrical operation device 9 for the optional device to a preset signal pressure if a priority function is applied depending on the operation amount of the attachment through detection of the first pressure detection sensor 12.

Referring to FIG. 6, a method for controlling a priority function control apparatus for a construction machine in accordance with a first embodiment of the present invention, including a variable displacement hydraulic pump (hereinafter referred to as "hydraulic pump") 1 and a pilot pump 8 connected to an engine (not illustrated); an optional device and an attachment connected to the hydraulic pump 1; an attachment operation lever 3 outputting an operation signal that corresponds to an operation amount when an operator performs an operation; an optional device spool 4 installed in a flow path between the hydraulic pump 1 and the optional device and shifted to control a flow direction of hydraulic fluid that is supplied to the optional device in response to signal pressure from an outside; an attachment spool 5 installed in a flow path between the hydraulic pump 1 and the attachment and shifted to control a start, a stop, and a direction change of the attachment in response to the operation of the attachment operation lever 3; an electrical operation device 9 for the optional device outputting an operation signal in accordance with an operator's operation; an electro proportional reducing valve 10 installed in a signal path between the pilot pump 8 and the optional device spool 4 to output secondary signal pressure that corresponds to the operation signal of the electrical operation device 9 for the optional device; a first pressure detection sensor 12 installed in a signal path between the attachment operation lever 3 and the attachment spool 5 to detect in real time signal pressure depending on the operation amount of the attachment operation lever 3 and to output a detection signal to a controller 11; and the controller 11 outputting an electrical control signal that corresponds to the operation signal of the electrical operation device 9 for the optional device to the electro proportional reducing valve 10, the method includes presetting a priority value or a ratio by the operator in consideration of load pressure of the optional device; detecting in real time signal pressure depending on the operation amount of the attachment operation lever 3 by a first pressure detection sensor 12 installed in a signal path between the attachment operation lever 3 and the attachment spool 5; and limiting the secondary signal pressure that is applied from the electro proportional reducing valve 10 to the optional device spool 4 to a preset signal pressure if a priority function is applied depending on the operation amount of the attachment through detection of the first pressure detection sensor 12.

In accordance with the above-described configuration, as illustrated in FIG. 4, the electrical operation device 9 for the optional device and the attachment operation lever 3 are operated to perform a combined work through driving of the optional device and the attachment. Accordingly, the attachment spool 5 is shifted by the signal pressure that passes through the attachment operation lever 3, and thus the hydraulic fluid from the hydraulic pump 1 is supplied to the attachment through the attachment spool 5. In this case, a detection signal of the signal pressure that is detected in real time by the first pressure detection sensor 12 installed in the signal path between the attachment operation lever 3 and the attachment spool 5 is transferred to the controller 11.

As illustrated in FIG. 6, as an operation signal in accordance with the operation of the electrical operation device 9 for the optional device is input to the controller 11, the controller 11 operates a control signal that corresponds to the operation signal (S10). The electrical control signal from the controller 11 is output to the electro proportional pressure reducing valve 10, and thus the signal pressure that flows from the pilot pump 8 to the electro proportional pressure reducing valve 10 is converted into the secondary signal pressure. Accordingly, the optional device spool 4 is shifted by the secondary signal pressure that is generated by the electro proportional pressure reducing valve 10, and thus the hydraulic fluid from the hydraulic pump 1 is supplied to the optional device through the optional device spool 4.

That is, the optional device and the attachment are driven by the hydraulic fluid that is supplied from the hydraulic pump 1 to perform the combined work.

In this case, load pressures generated by the optional device and the attachment differ from each other, and in this case, the amount of hydraulic fluid that is supplied from the hydraulic pump 1 to the optional device can be limited since the operator limits the signal pressure that is applied from the pilot pump 8 to the optional device spool 4 to a preset signal pressure (S40). Accordingly, in the case where the work is done through driving of the optional device and the attachment, the movement of the attachment can be prevented from being limited due to the load pressure of the optional device.

As illustrated in FIG. 9, the signal pressure that is applied to the optional device spool 4 in the case where the electrical operation device 9 for the optional device is operated can be limited to the preset signal pressure in accordance with the priority value or the ratio that is preset in the controller 11 by the operator in consideration of the load pressure of the optional device (S20).

The controller 11 outputs the electrical control signal that corresponds to an operation amount of the electrical operation device 9 for the optional device to the electro proportional reducing valve 10 when the electrical operation device 9 for the optional device is operated, in the case where the priority function is not applied (indicated by line "a" in the graph of FIG. 9), with the signal pressure that is applied from the electro proportional pressure reducing valve 10 to the optional device spool 4 by the operation of the electrical operation device 9 for the optional device (S50), and the controller 11 outputs the electrical control signal that limits the operation amount of the electrical operation device 9 for the optional device to the electro proportional reducing valve 10 when the electrical operation device 9 for the optional device is operated, in the case where the priority function is applied (indicated by line "b" in the graph of FIG. 9), with the signal pressure that is applied from the electro proportional pressure reducing valve 10 to the optional device spool 4 by the operation of the electrical operation device 9 for the optional device (S50).

As illustrated in FIG. 10, the signal pressure that is applied to the optional device spool 4 in accordance with an operation amount of the attachment operation lever 3 in the case where the attachment operation lever 3 is operated can be limited to the preset signal pressure in accordance with the priority value or the ratio that is preset in the controller 11 by the operator in consideration of the load pressure of the optional device (S30).

The controller 11 determines that the priority function is not applied (indicated by line "c" in the graph of FIG. 10) if the operation amount of the attachment operation lever 3 by the detection of the first pressure detection sensor 12 is smaller than a preset value, and outputs the electrical control signal that corresponds to an operation amount of the electrical operation device 9 for the optional device to the electro proportional reducing valve 10 when the electrical operation device 9 for the optional device is operated (S50), and the controller 11 determines that the priority function is applied (indicated by line "d" in the graph of FIG. 10) if the operation amount of the attachment operation lever 3 by the detection of the first pressure detection sensor 12 is equal to or larger than the preset value, and outputs the electrical control signal that can gradually limit the operation amount of the electrical operation device 9 for the optional device in reverse proportion to the operation amount to the electro proportional reducing valve 10 when the electrical operation device 9 for the optional device is operated (S50).

Referring to FIGS. 11 and 12, if a plurality of optional devices having different load pressures are provided and replaced, the controller 11 applies the priority value or the ratio (e.g., indicated by a bar graph displayed on a cluster of equipment) that is preset in the controller 11 by the operator to each of the optional devices. Accordingly, in the case of performing a work through replacement of any one of the plurality of optional devices having different load pressures, it becomes possible to easily cope with the change of the load pressure of the optional device.

Referring to FIG. 13, if a plurality of optional devices having different load pressures are provided and replaced, the controller 11 selects any one (e.g., optional device #1) of the plurality of optional devices (e.g., optional device #1 to optional device #n) that are displayed on a cluster of equipment, and variably controls the priority value or the ratio of the selected optional device (optional device #1) in accordance with an operator's control of a control button 16 that is displayed on the cluster.

Referring to FIG. 5, a priority function control apparatus for a construction machine in accordance with a second embodiment of the present invention includes a variable displacement hydraulic pump (hereinafter referred to as "hydraulic pump") 1 and a pilot pump 8 connected to an engine (not illustrated); an optional device (not illustrated) and an attachment (not illustrated) connected to the hydraulic pump 1; an attachment operation lever 3 outputting an operation signal that corresponds to an operation amount when an operator performs an operation; an optional device spool 4 installed in a flow path between the hydraulic pump 1 and the optional device and shifted to control a flow direction of hydraulic fluid that is supplied to the optional device in response to signal pressure from an outside; an attachment spool 5 installed in a flow path between the hydraulic pump 1 and the attachment and shifted to control a start, a stop, and a direction change of the attachment in response to the operation of the attachment operation lever 3; an electrical operation device 9 for the optional device outputting an operation signal in accordance with an operator's operation; an electro proportional reducing valve 10 installed in a signal path between the pilot pump 8 and the optional device spool 4 to output secondary signal pressure that corresponds to the operation signal of the electrical operation device 9 for the optional device; a second pressure detection sensor 13 installed in an upstream discharge flow path of the hydraulic pump 1 to detect in real time load pressure of the hydraulic pump 1 and to output a detection signal; a third pressure detection sensor 14 installed in a flow path between the attachment spool 5 and the attachment to detect in real time load pressure of the attachment and to output a detection signal; and a controller 11 presetting a priority value or a ratio by the operator in consideration of load pressure of the optional device, and limiting the signal pressure that is applied from the electro proportional reducing valve 10 to the optional device spool 4 by the operation of the electrical operation device 9 for the optional device to a preset signal pressure so that a difference value between the load pressure of the hydraulic pump 1 that is formed by the load pressure of the attachment when the optional device is not used and the load pressure of the hydraulic pump 1 that is formed by the load pressure of the attachment when the optional device is used becomes equal to or smaller than a preset value by the priority value or the ratio set by the operator.

The priority function control apparatus further includes a fourth pressure detection sensor 14 installed in a flow path between the optional device spool 4 and the optional device. To cope with a case where the operator can hardly predict the load pressure of the optional device, the detected load pressure of the optional device is displayed on a cluster of a cabin so that the operator can recognize the load pressure of the optional device that is detected by the fourth pressure detection sensor and easily set the priority value or the ratio through the displayed load pressure of the optional device.

Referring to FIG. 7, a method for controlling a priority function control apparatus for a construction machine in accordance with a second embodiment of the present invention, including a variable displacement hydraulic pump (hereinafter referred to as "hydraulic pump") 1 and a pilot pump 8 connected to an engine; an optional device and an attachment connected to the hydraulic pump 1; an attachment operation lever 3 outputting an operation signal that corresponds to an operation amount when an operator performs an operation; an optional device spool 4 installed in a flow path between the hydraulic pump 1 and the optional device and shifted to control a flow direction of hydraulic fluid that is supplied to the optional device in response to signal pressure from an outside; an attachment spool 5 installed in a flow path between the hydraulic pump 1 and the attachment and shifted to control a start, a stop, and a direction change of the attachment in response to the operation of the attachment operation lever 3; an electrical operation device 9 for the optional device outputting an operation signal in accordance with an operator's operation; an electro proportional reducing valve 10 installed in a signal path between the pilot pump 8 and the optional device spool 4 to output secondary signal pressure that corresponds to the operation signal of the electrical operation device 9 for the optional device; a first pressure detection sensor 12 installed in a signal path between the attachment operation lever 3 and the attachment spool 5 to detect in real time signal pressure depending on the operation amount of the attachment operation lever 3 and to output a detection signal to a controller 11; and the controller 11 outputting an electrical control signal that corresponds to the operation signal of the electrical operation device 9 for the optional device to the electro proportional reducing valve 10, the method includes presetting a priority value or a ratio by the operator in consideration of load pressure of the optional device; detecting in real time load pressure of the hydraulic pump 1 by detection of a second pressure detection sensor 13 installed in an upstream discharge flow path of the hydraulic pump 1, and detecting in real time load pressure of the attachment by detection of a third pressure detection sensor 14 installed in a flow path between the attachment spool 5 and the attachment; and limiting the signal pressure that is applied from the electro proportional reducing valve 10 to the optional device spool 4 by the operation of the electrical operation device 9 for the optional device to a preset signal pressure so that a difference value between the load pressure of the hydraulic pump 1 that is formed by the load pressure of the attachment when the optional device is not used and the load pressure of the hydraulic pump 1 that is formed by the load pressure of the attachment when the optional device is used becomes equal to or smaller than a preset value by the priority value or the ratio set by the operator.

In accordance with the above-described configuration, the electrical operation device 9 for the optional device and the attachment operation lever 3 are operated to perform a combined work through driving of the optional device and the attachment. Accordingly, hydraulic fluid from the hydraulic pump 1 is supplied to the attachment and the optional device through the attachment spool 5 and the optional device spool 4. Since this configuration is the same as the configuration of the priority function control apparatus of FIG. 4 in accordance with the first embodiment of the present invention, the detailed explanation thereof will be omitted.

In this case, as illustrated in FIG. 5, a detection signal of the load pressure of the hydraulic pump 1 that is detected in real time by the second pressure detection sensor 13 installed in the upstream discharge flow path of the hydraulic pump 1 is transferred to the controller 11. Further, a detection signal of the load pressure of the attachment that is detected in real time by the third pressure detection sensor 14 installed in the flow path between the attachment spool 5 and the attachment is transferred to the controller 11. Further, a detection signal of the load pressure of the optional device that is detected in real time by a fourth pressure detection sensor 15 installed in a flow path between the optional device spool 4 and the optional device is transferred to the controller 11.

As illustrated in FIG. 7, as an operation signal in accordance with the operation of the electrical operation device 9 for the optional device is input to the controller 11, the controller 11 operates a control signal that corresponds to the operation signal (S100). The signal pressure that is input from the pilot pump 8 in accordance with the control signal from the controller 11 is converted into secondary signal pressure by the electro proportional pressure reducing valve 10.

As illustrated in FIG. 9, the signal pressure that is applied to the optional device spool 4 in the case where the electrical operation device 9 for the optional device is operated can be limited to the preset signal pressure in accordance with the priority value or the ratio that is preset in the controller 11 by the operator in consideration of the load pressure of the optional device (S200).

On the other hand, the load pressure of the optional device that is detected by the fourth pressure detection sensor 15 and the load pressure that is generated in the attachment and is detected by the third pressure detection sensor 14 become different from each other. In this case, the amount of hydraulic fluid that is supplied from the hydraulic pump 1 to the optional device can be limited since the operator limits the signal pressure that is applied from the pilot pump 8 to the optional device spool 4 to a preset signal pressure (S500). Accordingly, in the case where a combined work is done through driving of the optional device and the attachment, the movement of the attachment can be prevented from being limited due to the load pressure of the optional device.

On the other hand, as illustrated in FIG. 11, the priority value or the ratio is preset by the operator in consideration of the load pressure of the optional device, and in this case, the signal pressure that is applied from the electro proportional pressure reducing valve to the optional device spool 4 by the operation of the electrical operation device 9 for the optional device is limited to the preset signal pressure so that a deviation value between the load pressure of the hydraulic pump 1 that is formed by the load pressure of the attachment when the optional device is not used and the load pressure of the hydraulic pump 1 that is formed by the load pressure of the attachment when the optional device is used becomes equal to or smaller than the set value by the priority value or the ratio set by the operator (S600).

In this case, the extent of preference is preset by the operator. In the case where the priority function is not applied, the signal pressure that is applied to the optional device spool 4 through operation of the electrical operation device 9 for the optional device is set to 100% to drive optional device #1 (at this time, the signal pressure that is applied to the attachment spool 5 through operation of the attachment operation lever 3 is set to 0% to drive attachment #2). In contrast, in the case where the priority function is applied, the signal pressure that is applied to the optional device spool 4 through operation of the electrical operation device 9 for the optional device is set to 35% to drive optional device #1 (at this time, the signal pressure that is applied to the attachment spool 5 through operation of the attachment operation lever 3 is set to 65% to drive the attachment #2).

On the other hand, in the same manner as the method for controlling a priority function control apparatus in accordance with the first embodiment of the present invention, if a plurality of optional devices having different load pressures are provided and replaced, the operator can apply the priority value or the ratio preset in the controller 11 to the respective optional devices, and variably control the priority value or the ratio of the optional device selected among the plurality of optional devices through operation of a control button 16 that is provided on a cluster.

Referring to FIG. 8, a method for controlling a priority function control apparatus for a construction machine in accordance with a third embodiment of the present invention, including a variable displacement hydraulic pump (hereinafter referred to as "hydraulic pump") 1 and a pilot pump 8 connected to an engine (not illustrated); an optional device and an attachment connected to the hydraulic pump 1; an attachment operation lever 3 outputting an operation signal that corresponds to an operation amount when an operator performs an operation; an optional device spool 4 installed in a flow path between the hydraulic pump 1 and the optional device and shifted to control a flow direction of hydraulic fluid that is supplied to the optional device in response to signal pressure from an outside; an attachment spool 5 installed in a flow path between the hydraulic pump 1 and the attachment and shifted to control a start, a stop, and a direction change of the attachment in response to the operation of the attachment operation lever 3; an electrical operation device 9 for the optional device outputting an operation signal in accordance with an operator's operation; an electro proportional reducing valve 10 installed in a signal path between the pilot pump 8 and the optional device spool 4 to output secondary signal pressure that corresponds to the operation signal of the electrical operation device 9 for the optional device; a first pressure detection sensor 12 installed in a signal path between the attachment operation lever 3 and the attachment spool 5 to detect in real time signal pressure depending on the operation amount of the attachment operation lever 3 and to output a detection signal to a controller 11; and the controller 11 outputting an electrical control signal that corresponds to the operation signal of the electrical operation device 9 for the optional device to the electro proportional reducing valve 10, the method includes presetting a priority value or a ratio by the operator in consideration of load pressure of the optional device; and limiting the signal pressure that is applied from the electro proportional reducing valve 10 to the optional device spool 4 depending on a priority value or a ratio that is preset when the electrical operation device 9 for the optional device is operated.

The priority function control apparatus for a construction machine in accordance with the third embodiment of the present invention has the same configuration as the configuration of the priority function control apparatus as illustrated in FIG. 4 except for the first pressure detection sensor 12 that detects the signal pressure that is applied to the attachment spool 5 in accordance with the operation of the attachment operation lever 3. Accordingly, the detailed explanation thereof will be omitted and the same reference numerals are used for the same constituent elements.

According to the above-described configuration, as illustrated in FIG. 8, as an operation signal in accordance with the operation of the electrical operation device 9 for the optional device is input to the controller 11, the controller 11 operates a control signal that corresponds to the operation signal (S1000). The electro proportional pressure reducing valve 10 generates secondary signal pressure that corresponds to the electrical control signal input from the controller 11. Since the optional device spool 4 is shifted by the secondary signal pressure that is applied to the optional device spool 4, the hydraulic fluid from the hydraulic pump 1 is supplied to the optional device through the optional device spool 4.

In this case, since the load pressures generated by the optional device and the attachment differ from each other, the signal pressure that is applied from the pilot pump 8 to the optional device spool 4 is limited to a signal pressure preset by the operator (S3000), and thus the amount of hydraulic fluid that is supplied from the hydraulic pump 1 to the optional device can be limited. Accordingly, in the case where the work is done through driving of the optional device and the attachment, the movement of the attachment can be prevented from being limited due to the load pressure of the optional device.

The signal pressure that is applied to the optional device spool 4 in the case where the electrical operation device 9 for the optional device is operated can be limited to the preset signal pressure in accordance with the priority value or the ratio that is preset in the controller 11 by the operator in consideration of the load pressure of the optional device (S2000).

The controller 11 outputs the electrical control signal that corresponds to an operation amount of the electrical operation device 9 for the optional device to the electro proportional reducing valve 10 in the case where the priority function is not applied, with the signal pressure that is applied to the optional device spool 4 by the operation of the electrical operation device 9 for the optional device (S4000), and the controller 11 outputs the electrical control signal to the electro proportional reducing valve 10 so as to limit the signal pressure that is applied to the optional device spool 4 to a preset signal pressure in the case where the priority function is applied, with the signal pressure that is applied to the optional device spool 4 by the operation of the electrical operation device 9 for the optional device (S4000).

On the other hand, in the same manner as the method for controlling a priority function control apparatus in accordance with the first embodiment of the present invention, if a plurality of optional devices having different load pressures are provided and replaced, the operator can apply the priority value or the ratio preset in the controller 11 to the respective optional devices, and variably control the priority value or the ratio of the optional device selected among the plurality of optional devices through the operation of a control button 16 that is provided on a cluster.

Although the invention has been described with reference to the preferred embodiments in the attached figures, it is noted that equivalents may be employed and substitutions made herein without departing from the scope of the invention as recited in the claims.

INDUSTRIAL APPLICABILITY

According to the present invention having the above-described configuration, the movement of the attachment or the increase of the driving speed due to the load pressure of the optional device can be prevented during working through the operation of the optional device and the attachment. Further, since the operator can set the order of preference of various kinds of optional devices, it is possible to easily cope with the change of the load conditions due to the replacement of the optional devices.

While the present invention has been described in connection with the specific embodiments illustrated in the drawings, they are merely illustrative, and the invention is not limited to these embodiments. It is to be understood that various equivalent modifications and variations of the embodiments can be made by a person having an ordinary skill in the art without departing from the spirit and scope of the present invention. Therefore, the true technical scope of the present invention should not be defined by the above-mentioned embodiments but should be defined by the appended claims and equivalents thereof.

What is claimed is:

1. A control apparatus for construction machine, comprising:

a variable displacement hydraulic pump and a pilot pump connected to an engine;

an optional device and an attachment connected to the hydraulic pump;

an attachment operation lever outputting an operation signal that corresponds to an operation amount when an operator performs an operation;

an optional device spool installed in a flow path between the hydraulic pump and the optional device and shifted to control a flow direction of hydraulic fluid that is supplied to the optional device in response to signal pressure from an outside;

an attachment spool installed in a flow path between the hydraulic pump and the attachment and shifted to control a start, a stop, and a direction change of the attachment in response to operation of the attachment operation lever;

an electrical operation device for the optional device outputting an operation signal in accordance with an operator's operation;

an electro proportional reducing valve installed in a signal path between the pilot pump and the optional device spool to output secondary signal pressure that corresponds to an operation signal of the electrical operation device for the optional device;

a first pressure detection sensor installed in a signal path between the attachment operation lever and the attachment spool to detect in real time signal pressure depending on the operation amount of the attachment operation lever and to output a detection signal; and a controller presetting a priority value or a ratio by the operator in consideration of load pressure of the optional device, and limiting the signal pressure that is applied from the electro proportional reducing valve to the optional device spool by operation of the electrical operation device for the optional device to a preset signal pressure depending on the operation amount of the attachment through detection of the first pressure detection sensor.

2. A control apparatus for a construction machine comprising:

a variable displacement hydraulic pump and a pilot pump connected to an engine;

an optional device and an attachment connected to the hydraulic pump;

an attachment operation lever outputting an operation signal that corresponds to an operation amount when an operator performs an operation;

an optional device spool installed in a flow path between the hydraulic pump and the optional device and shifted to control a flow direction of hydraulic fluid that is supplied to the optional device in response to signal pressure from an outside;

an attachment spool installed in a flow path between the hydraulic pump and the attachment and shifted to control a start, a stop, and a direction change of the attachment in response to operation of the attachment operation lever;

an electrical operation device for the optional device outputting an operation signal in accordance with an operator's operation;

an electro proportional reducing valve installed in a signal path between the pilot pump and the optional device spool to output secondary signal pressure that corresponds to an operation signal of the electrical operation device for the optional device;

a second pressure detection sensor installed in an upstream discharge flow path of the hydraulic pump to detect in real time load pressure of the hydraulic pump and to output a detection signal;

a third pressure detection sensor installed in a flow path between the attachment spool and the attachment to detect in real time load pressure of the attachment and to output a detection signal; and a controller presetting a priority value or a ratio by the operator in consideration of load pressure of the optional device, and limiting the signal pressure that is applied from the electro proportional reducing valve to the optional device spool by operation of the electrical operation device for the optional device to a preset signal pressure so that a difference value between the load pressure of the hydraulic pump that is formed by the load pressure of the attachment when the optional device is not used and the load pressure of the hydraulic pump that is formed by the load pressure of the attachment when the optional device is used becomes equal to or smaller than a preset value by the priority value or the ratio set by the operator.

3. The control apparatus for a construction machine according to claim 2, wherein the controller comprises a fourth pressure detection sensor installed in a flow path between the optional device spool and the optional device.

4. The control apparatus for a construction machine according to claim 3, wherein detected load pressure of the optional device is displayed on a cluster of a cabin so that the operator can recognize the load pressure of the optional device that is detected by the fourth pressure detection sensor.

5. A method for controlling a control apparatus for a construction machine, including a variable displacement hydraulic pump and a pilot pump connected to an engine; an optional device and an attachment connected to the hydraulic pump; an attachment operation lever outputting an operation signal that corresponds to an operation amount when an operator performs an operation; an optional device spool installed in a flow path between the hydraulic pump and the optional device and shifted to control a flow direction of hydraulic fluid that is supplied to the optional device in response to signal pressure from an outside; an attachment spool installed in a flow path between the hydraulic pump and the attachment and shifted to control a start, a stop, and a direction change of the attachment in response to operation of the attachment operation lever; an electrical operation device for the optional device outputting an operation signal in accordance with an operator's operation; an electro proportional reducing valve installed in a signal path between the pilot pump and the optional device spool to output secondary signal pressure that corresponds to an operation signal of the electrical operation device for the optional device; and a controller outputting an electrical control signal that corresponds to the operation signal of the electrical operation device for the optional device to the electro proportional reducing valve, the method comprising:

presetting a priority value or a ratio by the operator in consideration of load pressure of the optional device;

detecting in real time signal pressure depending on the operation amount of the attachment operation lever by a first pressure detection sensor installed in a signal path between the attachment operation lever and the attachment spool; and limiting the secondary signal pressure that is applied from the electro proportional reducing valve to the optional device spool to a preset signal pressure depending on the operation amount of the attachment through detection of the first pressure detection sensor.

6. The method according to claim 5, wherein the controller outputs an electrical control signal that limits the operation amount of the electrical operation device for the optional device to the electro proportional reducing valve when the electrical operation device for the optional device is operated, with the signal pressure that is applied to the optional device spool by the operation of the electrical operation device for the optional device.

7. The method according to claim 5, wherein if a plurality of optional devices having different load pressures are provided and replaced, the controller displays the priority value or the ratio of each of the optional devices that is preset in the controller by the operator as a bar graph displayed on a cluster of equipment.

8. The method according to claim 5, wherein if a plurality of optional devices having different load pressures are provided and replaced, the controller selects any one of the plurality of optional devices that are displayed on a cluster of equipment, and controls increment/decrement of the priority value or the ratio of the optional device selected by the operator by a control button.

9. A method for controlling a control apparatus for a construction machine, including a variable displacement hydraulic pump and a pilot pump connected to an engine; an optional device and an attachment connected to the hydraulic pump; an attachment operation lever outputting an operation signal that corresponds to an operation amount when an operator performs an operation; an optional device spool installed in a flow path between the hydraulic pump and the optional device and shifted to control a flow direction of hydraulic fluid that is supplied to the optional device in response to signal pressure from an outside; an attachment spool installed in a flow path between the hydraulic pump and the attachment and shifted to control a start, a stop, and a direction change of the attachment in response to operation of the attachment operation lever; an electrical operation device for the optional device outputting an operation signal in accordance with an operator's operation; an electro proportional reducing valve installed in a signal path between the pilot pump and the optional device spool to output secondary signal pressure that corresponds to an operation signal of the electrical operation device for the optional device; and a controller outputting an electrical control signal that corresponds to the operation signal of the electrical operation device for the optional device to the electro proportional reducing valve, the method comprising:

presetting a priority value or a ratio by the operator in consideration of load pressure of the optional device;

detecting in real time load pressure of the hydraulic pump by detection of a second pressure detection sensor installed in an upstream discharge flow path of the hydraulic pump, and detecting in real time load pressure of the attachment by detection of a third pressure detection sensor installed in a flow path between the attachment spool and the attachment; and limiting the signal pressure that is applied from the electro proportional reducing valve to the optional device spool by operation of the electrical operation device for the optional device to a preset signal pressure so that a difference value between the load pressure of the hydraulic pump that is formed by the load pressure of the attachment when the optional device is not used and the load pressure of the hydraulic pump that is formed by the load pressure of the attachment when the optional device is used becomes equal to or smaller than a preset value by the priority value or the ratio set by the operator.

10. A method for controlling a control apparatus for a construction machine, including a variable displacement hydraulic pump and a pilot pump connected to an engine; an optional device and an attachment connected to the hydraulic pump; an attachment operation lever outputting an operation signal that corresponds to an operation amount when an operator performs an operation; an optional device spool installed in a flow path between the hydraulic pump and the optional device and shifted to control a flow direction of hydraulic fluid that is supplied to the optional device in response to signal pressure from an outside; an attachment spool installed in a flow path between the hydraulic pump and the attachment and shifted to control a start, a stop, and a direction change of the attachment in response to operation of the attachment operation lever; an electrical operation device for the optional device outputting an operation signal in accordance with an operator's operation; an electro proportional reducing valve installed in a signal path between the pilot pump and the optional device spool to output secondary signal pressure that corresponds to an operation signal of the electrical operation device for the optional device; and a controller outputting an electrical control signal that corresponds to the operation signal of the electrical operation device for the optional device to the electro proportional reducing valve, the method comprising:

presetting a priority value or a ratio by the operator in consideration of load pressure of the optional device; and limiting the signal pressure that is applied from the electro proportional reducing valve to the optional device spool depending on a priority value or a ratio that is preset when the electrical operation device for the optional device is operated.

* * * * *